United States Patent [19]

Juba et al.

[11] Patent Number: 4,476,657

[45] Date of Patent: Oct. 16, 1984

[54] PRECAST CONCRETE STRUCTURAL UNITS AND BURIAL VAULTS

[75] Inventors: Bernard T. Juba, White Bear Lake; Michael J. V. Giessen, Blaine, both of Minn.

[73] Assignee: H. B. Fuller, St. Paul, Minn.

[21] Appl. No.: 266,369

[22] Filed: May 22, 1981

[51] Int. Cl.[3] ..... E04H 13/00; B32B 13/00

[52] U.S. Cl. ..... 52/139; 52/135; 428/327; 428/462; 428/446; 428/517; 428/519; 428/523; 428/703; 264/256; 264/135

[58] Field of Search ..... 52/139, 135; 428/703, 428/517, 519, 462, 327, 523, 446

[56] References Cited

U.S. PATENT DOCUMENTS

| | | | |
|---|---|---|---|
| 2,866,731 | 12/1958 | Van Epp | 428/517 |
| 3,439,461 | 4/1969 | Chandler et al. | 52/139 |
| 3,887,748 | 6/1975 | Swedenberg et al. | 428/703 |
| 4,091,162 | 5/1978 | Henderson et al. | 428/327 |
| 4,112,176 | 9/1978 | Bailey | 428/327 |
| 4,132,043 | 1/1979 | Juba | 428/517 |
| 4,314,390 | 2/1982 | Darby et al. | 52/135 |

*Primary Examiner*—C. Ives

*Attorney, Agent, or Firm*—Merchant, Gould, Smith, Edell, Welter & Schmidt

[57] ABSTRACT

A precast concrete structural unit is provided including a concrete sub-unit and a plastic resinous sheet. The sheet is adhered to the sub-unit at the time of pouring the concrete, utilizing a polychloroprene contact adhesive. The structural unit may further include adhesive coated reinforcement. Among the concrete structural units which are provided is a burial vault including concrete wall portions and a plastic resinous liner. The liner is adhered to the wall portions, at the time of pouring the concrete, utilizing the polychloroprene contact adhesive. The vault may also include adhesive coated reinforcement. The polychloroprene contact adhesive is essentially a blended aqueous latex comprising hydrophilic chloroprene copolymer latex particles and emulsified or dispersed hydrocarbon resin tackifier particles.

8 Claims, 12 Drawing Figures

PRECAST CONCRETE STRUCTURAL UNITS AND BURIAL VAULTS

FIELD OF THE INVENTION

The present invention relates to concrete construction, e.g. precast concrete structural units. An aspect of this invention relates to burial vaults, particularly to concrete burial vaults having plastic liners. Still another aspect of this invention relates to reinforced concrete structures, e.g. cast concrete beams and panels reinforced with metal bars, mesh, or the like.

DESCRIPTION OF THE PRIOR ART

Concrete as a construction material has a long and interesting history. Although concrete is often thought of as being of recent origin, its history actually dates back to the early Romans who used a crude form of concrete in construction of the aquaducts. Steel reinforced concrete was in use during the 19th Century. The first documented use of precast concrete was in the cathedral Notre Dame du Haut which was constructed in France in 1923. In that instance the precast concrete structural units werreinforced concrete was in use during the 19th Century. The first documented use of precast concrete was in the cathedral Notre Dame du Haut which was constructed in France in 1923. In that instance the precast concrete structural units were screen walls.

Precast, concrete structural units have been used in a wide variety of environments. Perhaps the earliest use of such precast units was a screen to provide a certain degree of privacy. Precast wall panels for use in buildings have been provided which carry no loads other than perhaps the force exerted by the wind. Such precast wall panels typically have a height equivalent to the floor-to-floor dimension of the building in which they are incorporated. Precast wall panels, in a wide variety of shapes, sizes, and finishes have also been used.

Precast wall panels have also been used as load-bearing units. Reinforcement, particularly with steel, becomes of major importance when precast wall panels are so used. Precast wall panels may also be used as wall supporting units, form work, and as shear walls extending over a plurality of floors or levels in a building. Various other precast concrete structural units have been known such as street furniture, planters, lighting standards, ornamental work, art, and sculpture.

Precast concrete structural units have certain significant advantages over other structural materials. Perhaps one of the more important is that of providing a wide range of design expression in architecture. The quality control of precast concrete can be closely controlled thus providing material often superior in quality to poured concrete.

Precast concrete structural units generally are prepared by pouring wet mix concrete into suitably-shaped, reusable mold forms. The mold forms typically are made of steel and may be one piece molds or multi-piece molds, the latter being disassembled for removal of the poured concrete panel.

In the past some structural units have been provided with decorative surfaces. Perhaps the most prevalent decorative surface is provided by preparing the concrete utilizing a white sand resulting in a finished product which is very light in color. Other surfacing has been provided by washing away a portion of the concrete leaving exposed aggregate.

One use of load-bearing concrete structural units (which are not necessarily decorative) involves the formation of beam-like shapes which, when in place, are anchored at their ends and subject to deformation in the middle. To provide resistance against deformation or even failure, these elongated concrete structural units are typically reinforced with rods or bars which comprise steel. As a general rule of thumb, it is preferable to locate the reinforcing bars or rods a certain minimum distance from the exterior of the structural unit, so that these metal reinforcing means will be adequately protected from corrosion by water seeping into cracks in the unit. However, "burying" the reinforcing bars or rods in this fashion decreases their contribution to the strength of the beam. The degree of "burying" (or distance from the surface of the structural unit), even though somewhat excessive from a structural reinforcement standpoint, is well justified by protection from corrosion, since corrosion can have a very devastating effect upon the deformation or failure resistance provided by the metal reinforcement means.

One highly specialized type of concrete construction is the well-known burial vault, which provides protection for the interior of a grave. Early embodiments of concrete burial vaults were made of single wall reinforced concrete having an asphalt inner liner. A common problem encountered with such concrete burial vaults was infiltration of moisture through the porous concrete walls. Such infiltration is produced by hydrostatic pressure in the grave.

Subsequently, burial vaults constructed of concrete walls and plastic resinous liners were developed, as illustrated in U.S. Pat. Nos. 3,439,461 and 3,787,545. An objective in the manufacture of these types of burial vaults is the formation of a good bond between the plastic liner and the concrete. Typically, the wet, settable concrete is poured into contact with the plastic liner, and an adhesive is used to provide a bond between the liner and the subsequently cured concrete. The adhesive bond is preferably capable of withstanding a variety of extreme tests, including freeze-thaw cycling.

The state of the art of concrete structural units and burial vaults is believed to be particularly well illustrated by U.S. Pat. No. 4,128,981 (Juba), issued Dec. 12, 1978, and U.S. Pat. No. 4,132,043 (Juba), issued Jan. 2, 1979. In addition to illustrating the state of the art, these patents describe an extremely effective solution to the problem of obtaining a good bond between the wet concrete and the plastic liner, which bond can be freeze-thaw stable. The approach used by the two aforementioned Juba patents involves the use of a polychloroprene contact adhesive.

Generally speaking, a wide variety of contact adhesives are known, but few of these have been found suitable for use in the technology described in the aforementioned Juba patents. For example, water-based contact adhesives or contact cements are known, but many of these (e.g. the acrylic latex adhesives) fail to meet some of the severe standards imposed upon adhesives for bonding plastic liners to burial vaults or other concrete structural units. The plastic sheets typically considered most suited for insertion into the mold in which the precast concrete structural unit is formed comprise synthetic organic resins having as much as three times the expansion coefficient of cured concrete. In a severe freeze-thaw cycle ranging from −40° C. to, for example, 60° C., extreme stresses can cause total failure at some point near the surface of the structure, even if the adhesive bond itself does not fail.

GENERAL DISCUSSION OF THE PRESENT INVENTION

It has now been discovered that a water-based contact adhesive can be applied to one side of a plastic resinous sheet (e.g. a burial vault liner), dried to the touch, inserted in a mold, brought into contact with poured wet settable concrete in the mold, and successfully and stably bonded to the subsequently cured concrete. It has also been discovered that a reinforced concrete member can be prepared from wet settable concrete and corrodable metal reinforcement means by:

(a) coating with a water-based polychloroprene contact adhesive the surfaces of the metal reinforcement means which will be in contact with the wet settable concrete;

(b) drying the coating until it is dry to the touch; and (c) combining the thus-coated metal reinforcement means with wet settable concrete to form the reinforced member. In this reinforced concrete unit or member (e.g. a cast concrete beam), the coating of dry-to-the-touch contact adhesive provides a corrosion-resistant layer which is adherent to concrete and reduces the need for "burying" the reinforcing member deep in the concrete structure in order to protect it from loss of strength due to potentially corrosive attack by moisture.

The use of a water-based contact adhesive has a number of advantages over the solvent-based type, including ease of uniform application; virtual elimination of health and/or fire hazards posed by organic solvents; less "stringing" and "dragging" of the adhesive, particularly over lap marks; higher total solids levels, thereby providing more efficient application; and the increased volatility of the aqueous carrier medium over some of the commonly used organic solvents such as toluene. That is, any water accidentally trapped in the adhesive film should have a much better chance of dissipating itself through the wet poured concrete as compared to a higher-boiling liquid such as toluene.

With all these advantages of water-based or latex contact adhesives in mind, the search for a suitable polychloroprene ("Neoprene") latex adhesive would naturally deserve an intense effort. There are, however, a number of difficulties to be considered in formulating a latex polychloroprene contact adhesive which will simply step in and and do the job so ably accomplished by closely-related, solvent-based materials. One factor to be considered is the stability of the polychloroprene latex itself. Many years ago, the only available polychloroprene latexes or latices were relatively unstable emulsions or dispersions, and a variety of conditions could cause the latex particles to prematurely coalesce. In recent years, more stable polychloroprene latexes have been developed, and it is believed to be important to the objectives of this invention that the water-based polychloroprene contact adhesive include hydrophilic chloroprene copolymer latex particles, e.g. copolymers of chloroprene and a carboxylic acid (or carboxylate)-containing comonomer. Another factor to consider is the ability of the contact adhesive to form strong bonds when it is dry to the touch. Tackifying resins can be combined with polychloroprene to provide a strong contact adhesive, and such combinations are mentioned in U.S. Pat. Nos. 4,128,981 and 4,132,043, the discussion in these patents generally centering around phenolic resins. Water-based polychloroprene latexes can, however, be very difficult to effectively tackify.

It has now been discovered that a surprisingly effective water-based polychloroprene contact adhesive can be obtained from a blend comprising the hydrophilic chloroprene copolymer latex particles and emulsified or dispersed hydrocarbon resin tackifier particles.

Although various types of tackifier resins are known, such as hydrogenated rosin esters, esters of polyhydric alcohols, phenol-aldehyde resins, and the like, the water-emulsified or -dispersed form of the class of materials known as "hydrocarbon resins" are the tackifiers of choice in this invention and may be essential for meeting a number of performance requirements such as freeze-thaw stability of the plastic/adhesive/concrete bond, high solids content of the adhesive, non-running and non-sagging behavior, long-term resistance to aging, and strengthening of the adhesive bond performance. In industrial practice "hydrocarbon resin" is a term of art relating to resins in the molecular weight range of a few hundred up to about 6,000 or 8,000 which are obtained or synthesized from rather basic hydrocarbonaceous materials such as petroleum, coal tar, turpentine, and the like. A good description of "hydrocarbon resins" can be found in Kirk-Othmer, *Encyclopedia of Chemical Technology,* Second Edition, Volume 11, Interscience, New York, 1966, page 242. Some resins which technically contain elements other than carbon and hydrogen (e.g. the coumarone-indenes) are conventionally included within this class called "hydrocarbon resins".

Many years ago, it was discovered that "hydrocarbon resin" particles can be stably dispersed or emulsified in water, typically with the help of surface active agents such as the anionic surfactants or emulsifiers. Such stably dispersed or emulsified hydrocarbon resins have been commercially available for some time.

All aqueous dispersions or emulsions of hydrocarbon resins do not work with equal effectiveness in this invention. It is preferred that the hydrocarbon resin itself be a vinyl arene polymer, e.g. a thermoplastic polymer comprising one or more types of styrene units, particularly styrene derivatives or analogs such as alpha-methyl styrene and/or vinyl toluene. In bulk or non-dispersed form, such thermoplastic materials are typically copolymers having ring and ball softening points ranging from about 70° to about 120° C. When uniformly distributed in water as emulsions or dispersions, these thermoplastic copolymers provide systems with excellent mechanical and storage stability which will dry to films resistant to acids, bases, and water. They are known to be suitable for combination with other aqueous thermoplastic and/or elastomeric systems to produce excellent adhesives. Like most water-based emulsions or dispersions or latexes, their solids content can vary over a wide range. For efficient storage and shipping, there is no advantage to a total solids content below about 20%, but dilution to as low as 5 or 10% will not necessarily disturb some of the emulsion properties. Solids content levels in excess of 50% are easily achieved in practice, and latexes and dispersions with solids approaching the 70% level are known. The preferred hydrocarbon resin emulsions of this invention can be either homopolymeric or copolymeric and are prepared with an anionic emulsifier such as the alkali metal soap of rosin, but many other suitable anionic emulsifiers are known in the art. The viscosity of these hydrocarbon resin emulsions at room temperature is very manageable, typically well below 5,000 centipoise (cps), more typically below 1,000 cps. One preferred embodiment of such an emulsion is believed to be an emulsified thermoplastic copolymer containing repeating units derived from alphamethyl styrene and vinyl toluene.

As noted previously, a polychloroprene contact adhesive fully effective in this invention is essentially a blended aqueous latex comprising the hydrophilic chloroprene copolymer latex particles and the uniformly distributed (emulsified or dispersed) hydrocarbon resin tackifier particles; the blend can be prepared by obtaining the chloroprene latex and the hydrocarbon resin emulsion or dispersion from separate sources and simply combining them, since proper selection of these raw materials will avoid any incompatibility or tendency for the resulting blended latex to "break" or segregate. Nevertheless, not all proportions of polychloroprene latex and hydrocarbon resin or dispersion are equally effective in the invention. An excessively high level of polychloroprene can result, after drying, in a very hard film with rather low adhesion to some substrates. An excessive amount of hydrocarbon resin, on the other hand, will soften the film and perhaps significantly improve adhesion, but at the cost of lower tensile strength. One simple test for a good polychloroprene/hydrocarbon resin balance is the ability of the water-based coating to become dry to the touch fairly rapidly and still have, in this dry-to-the-touch form, excellent contact adhesive properties. A "dry to the touch" film is one with sufficient coherence such that it will not noticeably transfer when touched, e.g. with a human finger. In the preferred water-based contact adhesives used in this invention, some slight tackiness may be sensed when the "dry to the touch" film is contacted with a finger or probe. This modest tack is normal and entirely consistent with the contact adhesive performance requirements of the invention; this degree of tack is less than that characteristic of pressure-sensitive adhesives. If, on the other hand, some transfer of adhesive from the substrate to the finger or probe is noted, the adhesive layer is not "dry to the touch".

Assuming for the sake of simplicity that the solids content of the polychloroprene latex and that of the hydrocarbon resin dispersion or emulsion are in approximately the same range (e.g. 35–65%, more typically 40–60% by weight of solids), the optimum combination for a good balance of properties appears to center around a 1:1 weight ratio, e.g. from 1:2 to 2:1. The polychloroprene latex and the hydrocarbon resin emulsion or dispersion will be the two largest components of the water-based contact adhesive, and will typically together make up more than 80% (e.g. 85–99%) by weight of the adhesive system. Nevertheless, other ingredients can play a very useful role, including viscosity and/or thixotropy adjustment, acceleration of the drying or hardening of the chloroprene polymer chains, defoaming, chemical stabilization (e.g. antioxidant or other anti-degradation effects), and anti-settling and surface active effects (e.g. promoting the formation of a continuous film on substrates). In addition, substantially inert coloring agents, fillers, extenders, and the like can be included in minor amounts. Insofar as active ingredients other than polychloroprene film-formers and hydrocarbon resin tackifiers are concerned, the total amount of such active ingredients will typically range from about 1 to 15% by weight of the blended latex composition. Since the total solids (i.e. non-volatile component) in the composition will typically range from about 35 to 65% by weight, substantially the 65–35% by weight balance will comprise water. It is not necessary and may even be undesirable to dilute the water with compatible organic solvents (such as lower alcohols, ketones, etc.), although minor amounts of such solvents may have little or no detrimental effect. Nonpolar organic liquid diluents are even less preferred, and the major emulsion or dispersion or latex components are available in substantially solvent-free form, essentially the only liquid carrier being water. If the polychloroprene copolymer contains acidic salt-forming groups (e.g. —COOH, —$SO_3H$, —$OSO_2OH$, etc.), aqueous solutions of alkaline materials (e.g. alkali metal salts) can be added to promote salt-group formation in situ. Conversely, if the polychloroprene copolymer contains protonatable groups, aqueous acids can be added to promote such salt formation. Since the preferred type of emulsifier for the hydrocarbon resin is often anionic, anion-forming or anionic groups on the polychloroprene copolymer are preferred, particularly the acidic substituents mentioned previously.

In the event that organic liquid solvents are included in the polychloroprene contact adhesive, amounts less than 1 or 2% by weight are normally preferred, and such solvents are preferably high in water-compatibility, e.g. the monoethylene glycol and low molecular weight polyethylene glycol lower alkyl ethers and lower alkanoates. The use of such solvents is ordinarily not critical but can help with the introduction of organic thickeners and thixotropes into the composition.

As explained in U.S. Pat. No. 4,128,981, the curing or coalescing or hardening of the polychloroprene film can be improved with various oxides of Group II A and II B of the Periodic Table, e.g. zinc oxide or magnesium oxide. The preferred polychloroprene copolymers can contain other monomeric units besides chloroprene (2-chloro-1,3-butadiene) and a hydrophilic comonomer, examples of third or other additional comonomers being halogenated butyl rubber-forming units. It should be noted that a carboxyl functionality in a polychloroprene latex offers an opportunity for room temperature curing by ionic crosslinking with metal oxides in addition to greater ease of dispersion or emulsion in water. Crosslinking can also be achieved at elevated temperatures with organic crosslinking agents such as methylol ureas and methylol melamines, but room temperature curing is preferred. Dispersing agents or protective colloids such as polyvinyl alcohol can be included in the polychloroprene latex and are typically present in the commercially available latexes.

For good resistance to particle settling or premature coalescence, the size of the latex particles, emulsoids, or dispersoids should be as small as practically possible, ranging from the colloidal size range or slightly larger (e.g. about 0.01 micrometers) up to a maximum of a few micrometers. Particles substantially larger than about 5 or 10 micrometers tend to behave as suspensoids rather than dispersoids, and may require considerable assistance from emulsifying agents to remain uniformly dispersed in water. On the other hand, particles smaller than about 1 or 2 micrometers can be kept in stably emulsified form or dispersed form with the aid of conventional protective colloids and/or anionic emulsifiers, particularly those described previously. The Brookfield viscosity at 20° C. for the polychloroprene latex will be in roughly the same range as the hydrocarbon resin emulsion or dispersion and preferably will not exceed about 1,000 centipoise.

PLASTIC SHEETS SUITABLE FOR BONDING TO CONCRETE

Plastic resinous sheets suitable for use in this invention can comprise either thermoplastic or thermoset resins, including resin mixtures, block copolymers, graft copolymers, and the like. Resins with higher than normal coefficients of thermal expansion are not advantageous, since the difference in expansion between the resin and the concrete can greatly add to stresses during thermal cycling. Polychloroprene contact adhesives (including the latex-type adhesives of this invention) are useful for bonding a very wide variety of plastics to concrete, and the nature of the plastic sheet is dictated more by the end use of the structural unit than by any severe limitations of adhesive performance, although some resins may require special treatments to make them more bondable. For example, in many outdoor uses (such as loadbearing and non-load-bearing precast concrete construction panels) and sewer tile liners, vinyl halide homopolymers and copolymers, including plasticized polyvinyl chloride sheets or films are particularly suitable because of their resistance to weathering. For burial vault use, vacuum-formable plastics are ordinarily desirable, including homopolymers and copolymers of the vinyl arenes and the mono- and di-olefins. It can be particularly advantageous to select a bondable flexible polyolefin (such as flame-treated polyethylene) capable of being bent at least 90° without cracking. The burial vault liner can then be folded into a more compact shape for shipping after it has been molded.

Various preferred plastic surface sheets include, in addition to polyvinyl chloride and polyethylene, the polystyrenes, ABS plastic (acrylonitrile-butadiene-styrene), and acrylic polymers. Typical plastic sheets have a thickness in excess of 0.25 mm and more typically in excess of 0.5 mm. The sheet may be of any desired shape, for example, flat or corrugated. The sheet may be of any desired color, for example it may be a single color such as white or a plurality of colors such as variegations of yellow and blue. The sheet of the structural unit can be either decorative or purely functional; for example, the structural unit may include a plastic sheet in order to provide a smooth, non-abrasive surface or a surface better suited to the degree of sanitizing required in food processing plants.

The water-based polychloroprene adhesive is applied as a wet film which is normally considerably thicker than the "dry to the touch" film which results after the aqueous carrier has evaporated. Wet thicknesses in excess of 1 mil (*25* micrometers) are typical and may range in thickness up to 10 mils or more.

DETAILED DESCRIPTION OF THE STRUCTURAL UNIT

Figure 1:
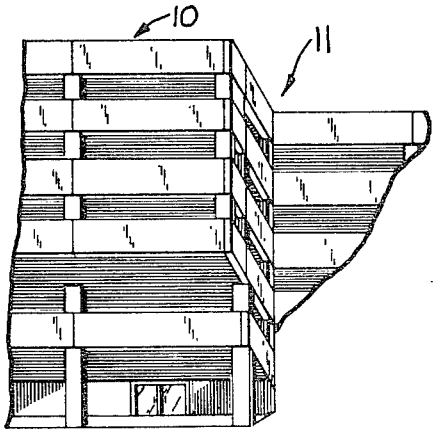
FIG. 1 shows a perspective view of a building incorporating the structural units of the present invention.

The structural unit 10 (FIG. 1) of the present invention may be a panel used in the construction of a building 11. The structural unit 10 may be disposed in any of various positions such as a horizontally disposed rectangle forming the front face of a building.

Figure 2:
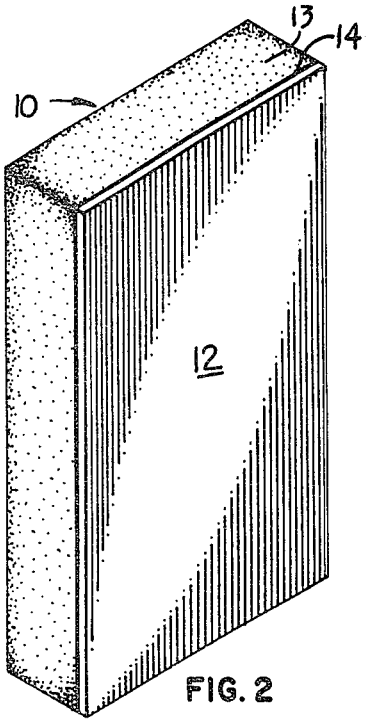
FIG. 2 is a front perspective view of an individual structural unit of the present invention.
Figure 3:
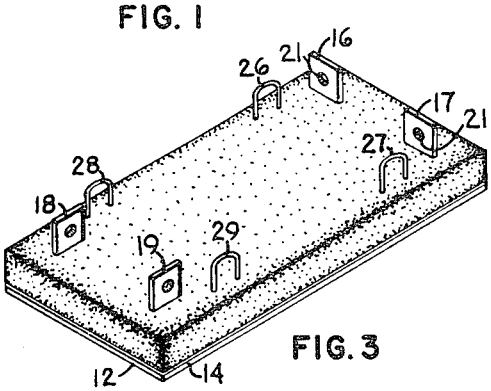
FIG. 3 is a rear perspective view of the structural unit of FIG. 2.

The structural unit 10 (FIGS. 1–3) includes a surface sheet 12 of plastic or thermoplastic material, a concrete sub-unit 13 and an adhesive layer 14. Adhesive layer 14 bonds sheet 12 to sub-unit 13. In this embodiment, the surface sheet 12 is planar in shape and may be of any desired color or colors. Moreover, the plastic sheet 12 may include surface shaping such as that providing a woodgrain or a leather effect.

The sub-unit 13 may include various hardware such as mounting flanges 16, 17, 18 and 19. The flanges 16–19 each include an opening 21 therein for the purpose of bolting the structural unit 10 into the building.

The structure 10 may include hardware such as U-shaped rod members 26, 27, 28 and 29 for handling the units. The handling members 26–29 are used for example, in removing the structural unit from the mold, loading the structural unit into crating or onto a carrier vehicle, as well as hoisting the structural unit to its appropriate position in the building.

Figure 4:
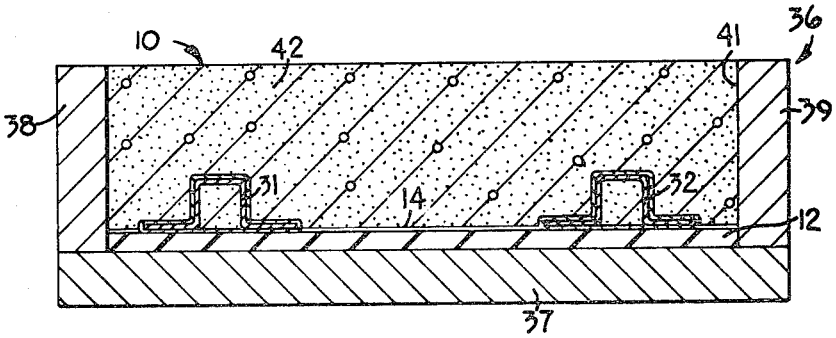
FIG. 4 is a cross-sectional view of a structural unit of the present invention while still in a mold.

The structural unit 10 may be prepared by coating the plastic sheet 12 with a suitable water-based contact adhesive 14 (see FIG. 4). Reinforcing members 31 and 32 may be adhered to sheet 12 utilizing the contact adhesive 14; further, the reinforcing members 31 and 32 may be hat bars which are likewise coated with the contact adhesive 14. The sheet 12 and reinforcing members 31, 32 may be placed in a mold 36.

The mold 36 may have a base plate 37 and a plurality of side plates such as 38, 39. For example, if the structural unit 10 is rectangular in shape, the mold 36 will include four side plates. The mold 36 provides a cavity 41 substantially the size of the desired structural unit 10. The sheet 12 is inserted in place and wet-mix concrete is poured into the mold preferably filling the mold to the upper edge of side plates 38 and 39. The concrete 42 is permitted to set or green cure. The unit 10 is then removed from the mold 36. If hardware such as members 16–19 and 26–29 is to be included, it is inserted into the wet concrete prior to setting thereof. The structural unit 10 after removal from mold 36 is permitted to complete curing.

Figure 5:
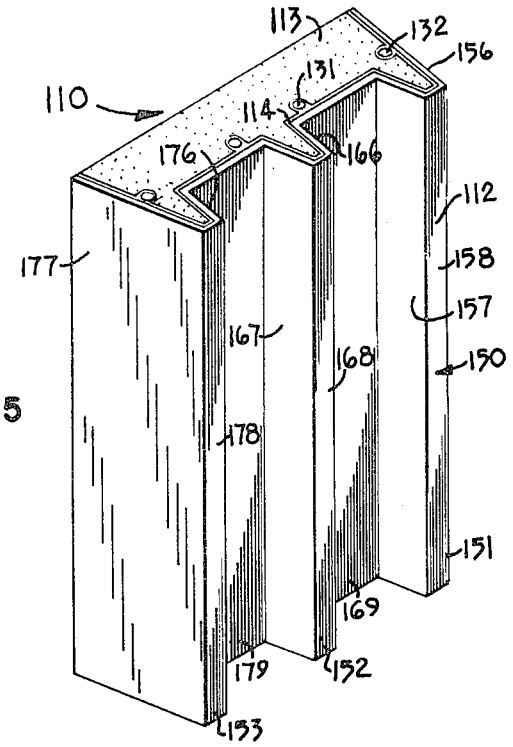
FIG. 5 is a cross-sectional view of another structural unit of the present invention.
Figure 6:
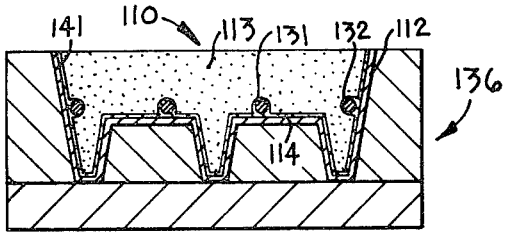
FIG. 6 is a cross-sectional view of the structural unit of FIG. 5 disposed in a mold.

An alternate structural unit 110 is shown in FIGS. 5 and 6. Structural unit 110 has a contoured face and includes a sheet 112 of plastic material, a concrete sub-unit 113 and a bonding layer of contact adhesive 114. The structural unit 110 may further include a plurality of reinforcing members such as deformed rods 131 and 132. The structural unit 110 has a face 150 including three spaced projections 151, 152 and 153. The projection 151 may have a pair of forwardly converging surfaces 156 and 157 and a front surface 158. Projection 152 may likewise include a pair of converging surfaces 166, 167 and a front surface 168. Surfaces 157 and 166 are interconnected by intermedia surface 169. The projection 153 has a pair of converging surfaces 176, 177 and a forward surface 178. Surfaces 167 and 176 are interconnected by intermediate surface 179.

The plastic sheet 112 may be formed into the desired shape by vacuum molding. In so doing, plastic sheet is heated until it becomes moldable. It is then drawn into a vacuum mold (not shown) of a shape conforming to the desired final shape of the sheet 112. The vacuum molded sheet is then permitted to cool until it becomes rigid. the sheet may be molded or formed by other techniques.

The structural unit 110 may include hardware similar to that described with regard to structural unit 10.

Structural unit 110 may be prepared in a one piece mold such as that shown in FIG. 6. The mold 136 has a cavity 141 conforming to the size and shape of the molded sheet 112. The molded sheet 112 is placed in mold 136 and the reinforcing members 131, 132 may be adhered to the sheet 112 utilizing adhesive 114. Wet pourable concrete is next poured into the mold 136 substantially filling the cavity 141. The concrete is permitted to green cure and the structural unit 110 is removed from mold 136.

Figure 7:
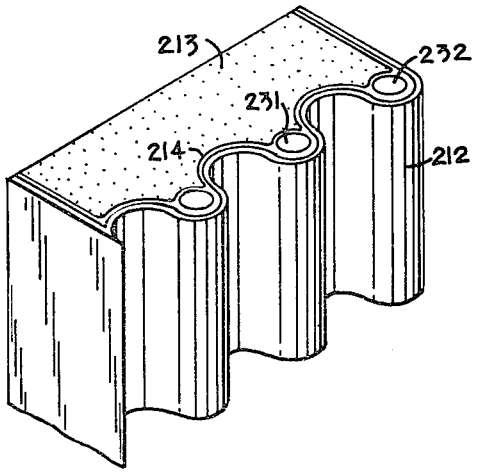
FIG. 7 is a perspective view of a further structural unit of the present invention;.

A further embodiment 210 is shown in FIG. 7. The structural unit 210 may be similar in construction to the units 10 and 110; however, the exposed forward surface in this instance is corrugated in shape. The structural unit 210 may include a plastic sheet material 212 having a plurality of rolling curves. The structural unit 210 further includes a concrete sub-unit 213 and a plurality of reinforcing rods 231 and 232. The rods 231 and 232 may be deformed re-bars. A layer of the water-based contact adhesive 214 is provided between sheet 212 and concrete sub-unit 213. Likewise the rods 231 and 232 may be coated with the adhesive 214. The structural unit 210 may be formed in a manner and by a method substantially like that described with regard to structural units 10 and 110 and therefore such methods will not be further described with regard to unit 210.

Of course, various modifications may be made without departing from the broader scope of the present invention. For example, the structural unit may have plastic sheet on two or more surfaces. In addition, there is considerable value in treating metal reinforcement means with the contact adhesive, even if no plastic sheet is adhered to a surface.

DETAILED DESCRIPTION OF A BURIAL VAULT

Figure 8:
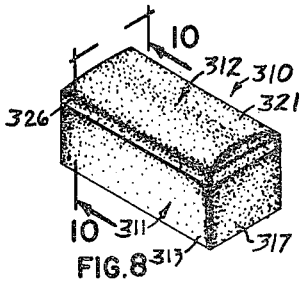
FIG. 8 shows a perspective view of a burial vault of of the present invention.
Figure 9:
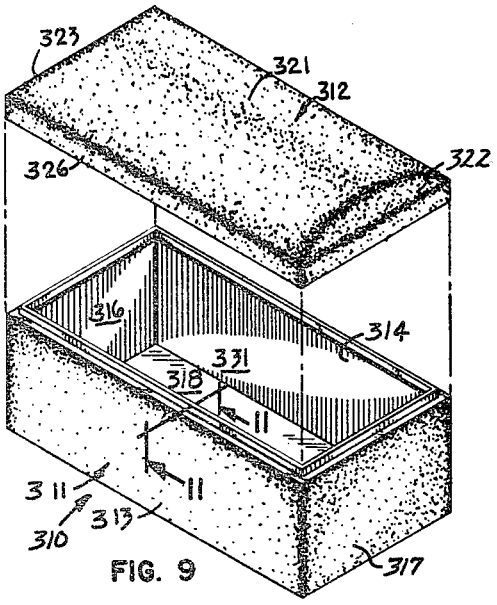
FIG. 9 is an exploded perspective view of the burial vault.
Figure 10:
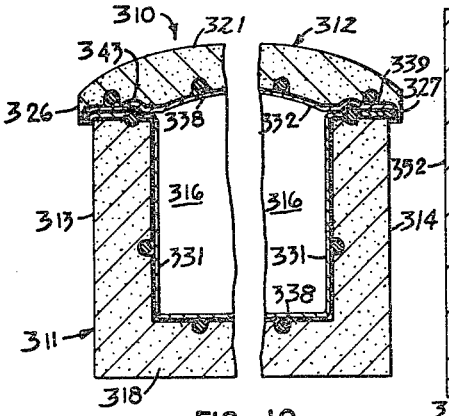
FIG. 10 is a cross-sectional view taken along the lines 10—10 in FIG. 8.

The burial vault 310 of the present invention, one embodiment of which is shown in FIGS. 8–10, may include a bottom portion or base member 311 and an upper portion or lid member 312. The base member 311 may be constructed having a pair of elongated side walls 313 and 314, a pair of end walls 316 and 317, and a bottom wall 318. The lid member 312 may include a dome-shaped top wall 321, a pair of end walls 322 and 323 and a pair of side walls 326 and 327.

The base member 311 and the lid member 312 each include a plastic liner 331 and 332, respectively. The liner 331 may be a preformed, vacuum molded wall unit of synthetic plastic resinous material. The resinous liner material may be polystyrene, polyvinyl chloride, ABS, polyester resin, butadiene-styrene or butadiene-acrylonitrile, or one of the aforementioned preferred polyolefins such as flame-treated polyethylene.. Likewise, the lid liner 332 may be a continuous film of such plastic resinous material.

Various methods may be used to shape the liner. The preferred approach is called bubble vacuum molding. A sheet of plastic, for example, having a thickness of about 0.180 inches, is stretched over a mold form. The plastic is warmed until it becomes softened and pressure is exerted to blow a bubble. The vacuum is drawn to pull the bubble into the mold and the plastic is again permitted to become rigid. The molded plastic desirably has a thickness of at least 0.020 inches. The edges are trimmed such as by die cutting. The liner 331 and the liner 332 each may provide a sealed surface within the bottom member 311 and lid member 312, respectively. The liner 331 and the liner 332 are each held in place with respect to the concrete using a contact adhesive which bonds to both the liner and the wet concrete.

Figure 11:
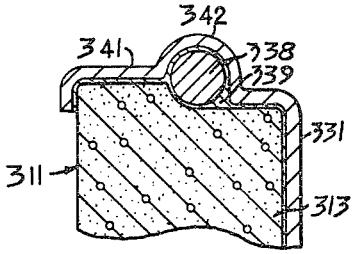
FIG. 11 is an enlarged cross-sectional view taken along the lines 4—4 in FIG. 2.

The vault 310 may include various reinforcements for purposes of strengthening the walls and resisting distortion. The present vault preferably includes reinforcement such as bar 338 shown in FIG. 11, which are disposed within the concrete but immediately beneath the film. The reinforcement may be deformed reinforcing bars. The metal reinforcement bar 338 are coated with the contact adhesive 339 and may be disposed in zones where the greatest strength is needed. Adhesive coated steel or other reinforcement members may be prebonded to the shaped liner prior to placement of the wet concrete. The contact adhesive adequately bonds the reinforcing member to the liner and no additional fixturing or holding device is required to maintain the reinforcing member in the desired position during subsequent manufacturing operations including the placement of the wet-mix concrete. Following pouring of the concrete, the metal reinforcement will be actually bonded to the concrete by the contact adhesive.

The metal reinforcement provides greater green strength to the vault which is important if the vault is to be moved following the initial curing of the concrete. For example,, the vault while still green may be moved from the mold to a storage area where final curing takes place. The metal reinforcing also provides greater stiffness and flexural strength even after the concrete is fully cured. This is of advantage to prevent sidewall movement during high pressure loading such as in triple depth internment where hydrostatic pressure may exceed 6 p.s.i.g. Sidewall movement is undesirable since it may produce failure of the seal between the bottom portion and the upper portion. Sidewall movement may result in cracking of the sidewall concrete and in turn water leakage. In the present invention, the metal reinforcement may be located in the area of greatest stress which generally is at the inner surface of the walls.

Various approaches may be followed for sealing between the lid member 312 and the base member 311. For example, the upper edge 341 of the base 311 may include a tongue 342 for engagement in a groove 343 in lid 312. Moreover, a sealant may be disposed in groove 343 to provide a waterproof seam between lid 312 and base 311. Various modifications may be made to the vault without departing from the broader scope of the present invention. For example the vault may be provided with an outer plastic wall.

Figure 12:
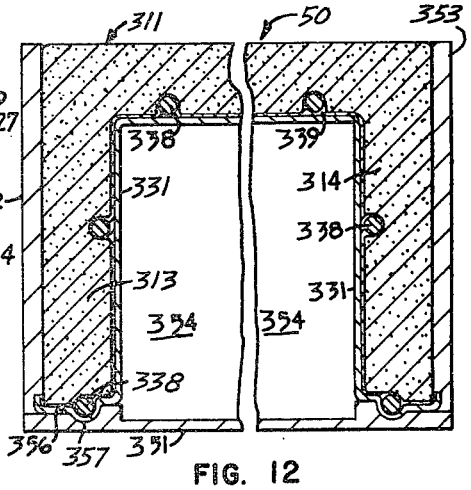
FIG. 12 is a cross-sectional view of the lower portion of the burial vault while disposed in a mold.

Apparatus suitable for manufacturing the burial vault of the present invention is disclosed in FIG. 12. The apparatus 350 includes a mold having a bottom plate 351 and four side plates such as 352 and 353. The mold further may include a central rectangularly-shaped portion 354. The portion 354 may be integral with the bottom plate 351; whereas, the side plates such as 352 and 353 desirably are removable for purposes of removing the burial vault from the mold. The lower plate 351 may include a surface shaped to provide the desired contour for the upper edge 341 of the vault sidewalls such as 313 and 314 and in particular providing the tongue 342.

The present invention provides a method for producing burial vaults. The method includes forming a shaped plastic film, applying a water-based contact adhesive to one surface of the film, disposing the film in a mold, and pouring wet flowable concrete into the mold in contact with the adhesive.

Various approaches may be used to shape the plastic film; however, the preferred approach is by bubble vacuum molding. Using such approach, a sheet of film is supported over a mold. The sheet is heated until it becomes moldable. Positive gaseous pressure is then applied to the sheet to blow a bubble. A vacuum is next drawn and the bubble is pulled into the vacuum mold and cooled until it becomes rigid. The film is molded in the shape of the inner surface of the desired burial vault. Such vacuum molds are conventional and are not described in detail herein. The vacuum mold is not to be confused for the vault mold 350. The edges of the shaped film or liner may be trimmed by die cutting. The trim may be reformed into sheet for later produced liners.

The shaped plastic film may be placed into the mold 350 in such a manner as to cover the mold central portion 355 and a peripheral surface 356. The plastic film is positioned with the finished surface toward the mold portions 354 and 356. Water-based contact adhesive is provided on the side of the film facing away from such mold portions. The contact adhesive may be applied to the film prior to or after placement of the film in the mold 350. The adhesive preferably is applied by paint roller or spraying the adhesive onto the film.

The mold side plates such as 352 and 353 are mounted and secured to mold portion 351. A wet flowable concrete mixture is prepared and poured into the mold 350 substantially filling such mold. Preferably, the mold is mounted on a vibrator which is in operation during the pouring of the concrete thereby reducing or eliminating bubbles and voids in the concrete. The concrete may be screeded off once the mold is filled thus removing excess concrete. In other words, the exposed surface of concrete is troweled to provide a uniform vault bottom wall. The concrete may have a compressive strength of 4500 p.s.i. (31,500 kPa) or greater and may be conventional construction concrete.

The concrete is permitted to set and cure until the burial vault member is capable of being handled. The burial vault may then be removed from the mold and placed in a storage area while the concrete completes the curing process. The base member 311 and the lid member 312 may be each made in substantially identical manner.

The following non-limiting Example illustrates a suitable water-based polychloroprene adhesive.

EXAMPLE

The two largest components of this contact adhesive are (1) a neoprene latex and (2) an anionic thermoplastic vinyl arene-type hydrocarbon emulsion. The neoprene latex solids have carboxyl functionality that can be used to achieve intermediate modulus properties. They are copolymers of chloroprene (2-chloro-1,3-butadiene) and methacrylic acid. Polyvinyl alcohol is included as a dispersing agent, and the total solids are 46% –47% by weight of the latex composition. The following additional properties are typical of these neoprene latex products.

| | |
|---|---|
| pH at 25° C.: | 7 |
| Specific gravity at 25° C.: | |
| Polymer: | 1.24 |
| Latex: | 1.08–1.09 |
| Average particle size, micrometers: | 0.3 |
| Surface tension at 20° C., dynes/cm (mN/m): | 47.0–58.0 |
| Brookfield viscosity at 20° C., centipoise, determined with Model LVF, spindle No. 2 - | |
| 6 r.p.m.: | 350–500 |
| 30 r.p.m.: | 200–350 |
| Acid equivalent in carboxylic equivalents per 100 gams latex solids: | 0.033 |

In the anionic, copolymerized thermoplastic hydrocarbon resin emulsion, the repeating units of the vinyl arene type are believed to include alphamethyl styrene and vinyl toluene. As in the case of the neoprene latex, the liquid carrier is aqueous, but the solids content is somewhat higher, i.e. 55%. The aqueous carrier is essentially solvent-free. The anionic emulsifier is a potassium soap or rosin, and a mildly alkaline pH helps to maintain the stability of the emulsion. Although the pH can range from 10 to 13, it is ordinarily preferred to maintain the pH above 11.0, and, if necessary, 20% potassium hydroxide solution can be added to adjust the pH. Total solids content can also vary within commercial specifications, which are 53–57%. These specifications provide for a viscosity at 25° C. within the range of 100–400 centipoise. Typical properties of the emulsion solids include a softening point (ring and ball) of 85° C. and a base resin color (50% resin solids in toluene) of 5 on the Gardner scale. The maximum particle size of the solids should not exceed 1.0 micrometers. Surface tension of the emulsion is typically 37 dynes/cm and the emulsion density at 25° C. is typically 1.04 g/cc.

The neoprene latex is, as noted above, sold as an essentially neutral liquid. For use in this invention, the pH of the latex is preferably adjusted upward to 10.0. As in the case of the hydrocarbon resin emulsion, 20% aqueous KOH can be used for this purpose.

If thickening of the neoprene/hydrocarbon resin waterbased blend is desired, natural or synthetic gums and similar cellulosic thickeners are suitable, the preferred thickener being a carboxymethylhydroxypropyl guar. Zinc oxide is included to "cure" the polychloroprene in the manner generally known in the art.

Optimum ranges and the specific formula of this Example are given below.

| Ingredient | Range, % by Weight |
|---|---|
| Chloroprene-methacrylic acid copolymer latex (neoprene latex) | 46–50 (assuming 46–47% solids) |
| Zinc oxide (60% dispersion) | 0.9–1.3 |
| Silicone oil/fatty acid ester defoamer | 0.08–0.12 |
| Thermoplastic vinyl arene-type hydrocarbon resin emulsion with anionic emulsifier | 46–50 (assuming 53–57% solids) |
| Antioxidant (40% dispersion) | 0.7–1.5 |
| Nonionic wetting agent | 0.4–0.6 |

The following is the presently preferred specific formula.

| Ingredient | Percent by Weight |
|---|---|
| Chloroprene-methacrylic acid copolymer latex (adjusted to pH 10.0 with 20% KOH) | 48.33 |
| Diethylene glycol monobutyl ether (added in two increments) | 0.43 |
| Carboxymethylhydroxypropyl guar | 0.11* |
| Zinc oxide (60% dispersion, pre-agitated before addition to the batch) | 1.10 |
| Defoamer, comprising a mixture of petroleum solvent, fatty acid ester, and a silcone oil | 0.10 |
| Thermoplastic vinyl arene-type hydrocarbon resin emulsion, anionic | 48.33 |
| Antioxidant (40 wt. % dispersion) compromising 2,2'-methylenebis (4-methyl-6 tertiary butyl phenol) | 1.10 |
| Wetting agent composition containing ethylene glycol, 2,4,7,9-tetramethyl-5-decyn-4,7-diol and a nonionic wetting agent ("SURFYNOL TG" [trademark]) | 0.50 |

*or amount effective to adjust viscosity.

The foregoing ingredients are added essentially in the order listed. Some of the diethylene glycol monobutyl ether is used to rinse a pre-mix container, but is included in the batch. The zinc oxide, defoamer, hydrocasrbon resin emulsion, antioxidant, and wetting agent are then blended in the order listed.

The foregoing formula was applied at a wet thickness of 4 mils (100 micrometers) to both polystyrene and ABS (acrylonitrile-butadiene-styrene) sheet stock, allowed to dry to a clear, non-transferring, slightly tacky state, and then placed in a mold so that the wet concrete could be poured into contact with the sheet and allowed to cure. A strong bond between the concrete and both types of plastic sheets was obtained. Three freeze-thaw cycles of (a) −40° C. for 24 hours followed by (b) 24 hours at room temperature did not cause failure of the bond, the plastic sheet, or the cured concrete. A similar success was obtained with a polystyrene burial vault liner of the type described in U.S. Pat. No. 3,439,461 (Chandler et al).

A further structural unit test was carried out with the same wet thickness of adhesive, ABS sheet, and polyvinyl chloride sheet. The wet concrete was allowed to cure for 28 days. No failure was observed after three of the following freeze-thaw cycles:

(a) 24 hours at −40° C.
(b) 24 hours at room temperature (20°–25° C.)
(c) 24 hours at 60° C. (82° C. for PVC)
(d) 24 hours at room temperature.

Good bonds were also obtained when the plastic sheet was 6.35 mm-thick polyethylene pipe stock, so long as the stock was flame treated on one surface by passing over a hot blue gas flame (1100° C.–2800° C.). To provide a realistic test for bonding to polyvinyl chloride sheet, 1.6 mm-thick plasticized PVC of the type used for lining concrete sewer pipe and concrete tanks was coated with the contact adhesive. In all cases the wet thickness was approximately 4 mils (100 micrometers). The plasticized PVC also became strongly bonded to the wet poured concrete.

What is claimed is:

1. A composite structural unit comprising a plastic resinous sheet, a concrete subunit, and a polychloroprene contact adhesive providing a bond between said sheet and said concrete prepared by a process comprising:

(a) coating said plastic sheet on one side with a latex adhesive, consisting essentially of a blend of an aqueous emulsion of hydrophilic chloroprene copolymer particles and an aqueous emulsion of hydrocarbon tackifier resin particles;
(b) drying said latex adhesive to the touch;
(c) contacting said adhesive with wet, pourable, uncured concrete; and,
(d) setting and curing said concrete.

2. The structural units of claim 1 wherein said unit includes metal reinforcement, said metal reinforcement being bonded to said concrete by said contact adhesive.

3. The structural unit of claim 2 wherein said metal reinforcment is further bonded to said sheet.

4. The composite structural unit of claim 1 which is a composite wall burial vault member.

5. The burial vault members of claim 4 wherein said vault includes metal reinforcement, said metal reinforcement being bonded to said concrete by contact adhesive.

6. The burial member of claim 5 wherein said metal reinforcement is also bonded to said sheet.

7. A composite wall burial vault member according to claim 4 wherein said plastic resinous sheet comprises a flexible polyolefin capable of being bent at least 90° without cracking.

8. A composite wall burial vault member according to claim 7 wherein said polyolefin comprises polyethylene.

* * * * *